United States Patent [19]

Hosmer et al.

[11] 4,378,659

[45] Apr. 5, 1983

[54] WINDOWS

[75] Inventors: Stephen L. Hosmer, Englewood, Colo.; Paul R. Steuer, Cheltenham, Pa.

[73] Assignee: Caterpillar Tractor Co., Peoria, Ill.

[21] Appl. No.: 925,300

[22] Filed: Jul. 17, 1978

[51] Int. Cl.[3] ..... E06B 1/04

[52] U.S. Cl. ..... 49/504

[58] Field of Search ..... 49/501, 504; 52/213, 52/716, 208, 204, 206, 207

[56] References Cited

U.S. PATENT DOCUMENTS 3,861,444 1/1975 Portwood ..... 49/504 X 4,042,004 8/1977 Kwan ..... 49/501 X

FOREIGN PATENT DOCUMENTS 849836 8/1970 Canada ..... 49/501

*Primary Examiner*—Philip C. Kannan

*Attorney, Agent, or Firm*—Joseph W. Keen

[57] ABSTRACT

Window for construction vehicle cabs or the like having following features: provides maximum cross sectional area for viewing; can be fastened into place by screws turned home from the inside and which are hidden from view after installation; and comprises a minimum number of parts which must be handled at installation and so speeds up the process.

2 Claims, 2 Drawing Figures

WINDOWS

This invention relates to windows and in particular relates to frames for windows especially suiting the same for employment in structure such as cabs or bodies of vehicles.

The invention is especially useful in connection with frames employed in such structures having spaced-apart inside and outside walls.

The invention contemplates a frame mounting the glazing which can be pushed into a structure opening from the outside, quickly secured in place by screws turned home from the inside and receive a flexible strip which covers the screws to complete the installation.

Among the advantages of the invention are: it permits a larger cross sectional area in the glazing and thereby increases visibility; reduces the number of parts handled at installation; and greatly improves asthetic appearance.

Figure 1:
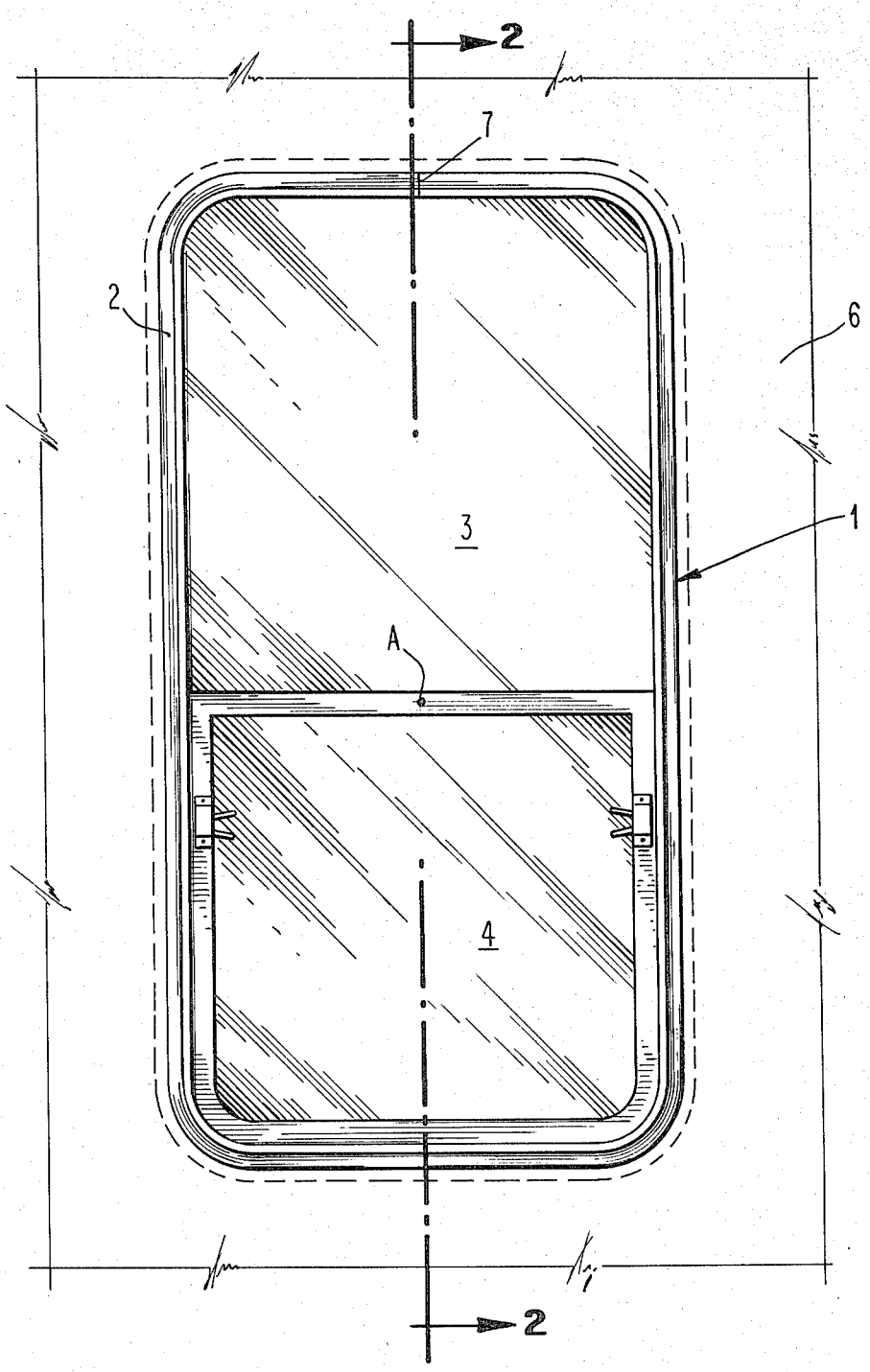
Figure 2:
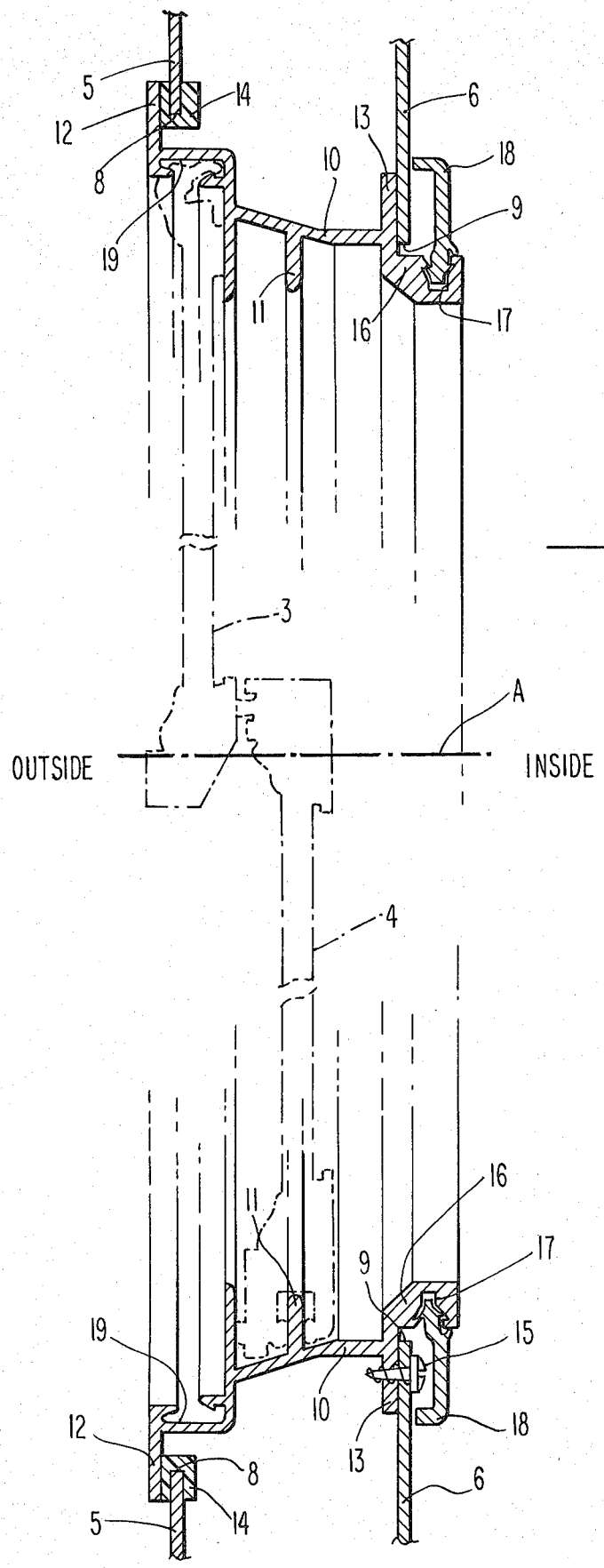

A preferred construction of the invention will be described below in connection with the following drawings wherein:

FIG. 1 is a front elevational view of a window assembly embodying the invention; and FIG. 2 is a side elevational view taken along the lines 2—2 of FIG. 1. In FIG. 1 the window assembly 1 has a peripherial annular frame 2 supporting the upper fixed glazing 3 and the lower movable glazing 4. The glazing 3 and 4 form no part of the invention and details of same will not be described. The glazings are indicated by the dotted lines in FIG. 2. The glazings are transparent and so form a viewing section. The frame and glazing assembly is adapted to be mounted in wall of a structure. In the particular case shown the structure is a construction vehicle cab having the outside wall 5 and inside wall 6. These walls have respectively outer opening 8 and inner opening 9 which receive the assembly.

FIG. 2 shows the cross sectional shape of the annular frame 2 which, in essence, is the subject matter of the invention.

Frame 2 is preferably an aluminum extrusion bent into desired annular shape, for example, as shown in FIG. 2, The two free ends of the frame are abutted to make a joint at 7 and secured by conventional means. The frame is symmetrical with respect to the axis A.

The frame 2 includes the center web 10, the interior of which has means 11 for mounting the glazing 3 and 4.

An outside peripheral flange 12 is connected to one edge of the web. The flange 12 extends radially outwardly. On the opposite edge of the web is an inside peripherial flange 13 which also extends radially outwardly, generally parallel to the flange 12.

The outside flange 12 is adapted to engage the edge of outside opening 8 or more particularly the gasket 14. The inside flange 13 is adapted to engage the edge of the inside opening 9.

The openings 8 and 9 are prepunched or precut in the walls 5 and 6 and have the same cross sectional shape. The openings are co-axial with the axis a. The cross section of the outer opening 8 is larger than the cross section of the inner opening 9. This structure allows the frame and glazing assembly to be pushed into position (with the flanges engaged with the walls) from the outside. In conjunction with this structure, the center web 10 is flared in a direction inside to outside. To accommodate the outside mounting, the inside flange 13 extends radially outwardly so that it will pass thru the outside opening 8 but not pass thru the inside opening 9. The outside flange 12 extends radially outwardly so that it will not pass thru the outer opening 8.

The inside wall 6 is prepunched with a plurality of apertures near the edge of the inside opening 9. The inside flange 13 is also prepunched with a plurality of apertures. When the frame is in the position as shown in FIG. 2, it can be adjusted so that the apertures are alinged. Self taping screws noted at 15 are then threaded thru the apertures. The screws draw the flanges 12 and 13 tight against the repective walls and lock the frame in position.

The inner edge of the web 10 carries a support or sill 16 including the channel 17. A cover 18 comprises a flexible plastic strip which is shaped to be pushed into the channel 17 and then extend over the screws 15. The screws are not visible from inside of the cab or other such structure.

The screws are available for demounting the window assembly simply by peeling off the flexible strip.

In closing it is to be noted that the web is formed with a channel 19 which is used for retaining flexible glazing strips for the upper glazing 3.

We claim:

1. In a window assembly comprising a transparent viewing section and an annular main frame carrying the viewing section and adapted to mount the assembly in a structure having inside and outside walls and an opening means therein, the annular main frame comprising:

an annular center web;

means on the interior of the web for mounting the viewing section;

an outside peripheral flange connected to one edge of the web and extending radially outwardly thereof, the outside flange being adapted to engage the outside of the outside wall of the structure mounting the window;

an inside peripheral flange connected to the opposite edge of the web and extending radially outwardly thereof, the inside flange being adapted to engage the outside of the inside wall of the structure mounting the window;

said flanges extending outwardly so that the periphery of the inner flange defines a cross sectional area smaller than the cross sectional area formed by the periphery of the outer flange and providing for the assembly to be pushed, from a direction outside to inside, into the structure opening and positioned with said flanges engaged as aforesaid;

aperture means on the inside flange to receive mounting screw bearing on and extending thru the inside wall of the structure; and a support connected to the inside flange and having means to support a cover for the heads of said mounting screws so that the heads can not be viewed from inside the structure.

2. In combination:

a window assembly comprising a transparent viewing section with an annular main frame carrying the viewing section and a structure having spaced apart inside and outside walls mounting the assembly;

said outside and inside walls respectively having outer and inner openings within which the assembly is disposed, the openings having the same cross-sectional shape and with the area of the outer opening being larger than the area of the inner opening and the openings being co-axial about the axis of the annular frame;

said frame having:

(a) an annular center web extending around and across the space between said walls;

(b) means on the interior of said web mounting the viewing section;

(c) an outside peripheral flange connected to one edge of the web and extending radially outwardly thereof and engaging the outside of said outside wall;

(d) an inside peripheral flange connected to the opposite edge of the web and extending radially outwardly thereof and engaging the outside of said inside wall;

(e) said flanges respectively extending outwardly so that the periphery of the inner flange defines a cross sectional area which is smaller than the cross sectional area formed by the periphery of the outer flange and providing for the assembly to be pushed, from a direction outside to inside, into said openings and positioned with said flanges engaged as aforesaid;

(f) apertures in the inside flange;

(g) a plurality of screws, the heads of which bear on said inside wall and the threads of which extend thru the wall and are threaded into said apertures, the screws tightly drawing said flanges respectively against said walls;

(h) a support connected to said web and having a channel; and (i) a flexible cover removably retained in said channel and covering said screw heads so that the same are not viewable from inside the structure.

* * * * *